US011754067B2

(12) United States Patent
Reukers et al.

(10) Patent No.: US 11,754,067 B2
(45) Date of Patent: Sep. 12, 2023

(54) FAULT DETECTION AND PREDICTION

(71) Applicant: QUANTUM SERVO PUMPING TECHNOLOGIES PTY LTD, Campbellfield (AU)

(72) Inventors: Darren Reukers, Campbellfield (AU); Peter Harding, Campbellfield (AU)

(73) Assignee: QUANTUM SERVO PUMPING TECHNOLOGIES PTY LTD, Campbellfield (AU)

( * ) Notice: Subject to any disclaimer, the term of this patent is extended or adjusted under 35 U.S.C. 154(b) by 302 days.

(21) Appl. No.: 17/290,477

(22) PCT Filed: Nov. 2, 2018

(86) PCT No.: PCT/AU2018/051186

§ 371 (c)(1),
(2) Date: Apr. 30, 2021

(87) PCT Pub. No.: WO2019/084620

PCT Pub. Date: May 9, 2019

(65) Prior Publication Data

US 2022/0056901 A1 Feb. 24, 2022

(51) Int. Cl.
*F04B 49/10* (2006.01)
*F04B 51/00* (2006.01)

(52) U.S. Cl.
CPC ..... *F04B 49/10* (2013.01); *F04B 51/00* (2013.01); *F04B 2201/0204* (2013.01);
(Continued)

(58) Field of Classification Search
CPC .. F04B 51/00; F04B 49/10; F04B 2201/0208; F04B 2201/0605; F04B 2201/0801;
(Continued)

(56) References Cited

U.S. PATENT DOCUMENTS 6,092,370 A * 7/2000 Tremoulet, Jr. ..... F04B 51/00 91/1
7,726,179 B2 * 6/2010 Muller ..... F04B 51/00 73/37

(Continued)

FOREIGN PATENT DOCUMENTS

WO 2008128303 A1 10/2008
WO 2009117765 A1 10/2009

(Continued)

OTHER PUBLICATIONS

International Search Report dated Dec. 24, 2018 for corresponding International Application No. PCT/AU2018/051186, filed Nov. 2, 2018.

(Continued)

*Primary Examiner* — Christopher S Bobish
(74) *Attorney, Agent, or Firm* — David D. Brush; Westman, Champlin & Koehler, P.A.

(57) ABSTRACT

A pump including one or more pumping chambers, one or more drive mechanisms for driving the one or more pumping chambers and a logic arrangement. The first pumping chamber of the one or more pumping chambers has a first inlet check valve, a first outlet check valve and a first temperature sensor. The logic arrangement is configured to identify a leak by applying logic to at least resistance-data indicative of a resistance of the first pumping chamber to the driving and temperature-data at least based on output from the first temperature sensor.

22 Claims, 5 Drawing Sheets

(52) U.S. Cl.
CPC ..... *F04B 2201/0208* (2013.01); *F04B 2201/0605* (2013.01); *F04B 2201/0801* (2013.01); *F04B 2201/0803* (2013.01); *F04B 2203/0201* (2013.01); *F04B 2205/03* (2013.01)

(58) Field of Classification Search
CPC ..... F04B 2201/0803; F04B 2201/0204; F04B 2203/0201; F04B 2205/03
See application file for complete search history.

(56) References Cited

U.S. PATENT DOCUMENTS

| | | | | |
|---|---|---|---|---|
| 8,161,800 | B2 * | 4/2012 | Summers | G01M 3/002 418/2 |
| 8,984,930 | B2 * | 3/2015 | Worden | F04B 49/065 73/47 |
| 9,759,213 | B2 * | 9/2017 | Bassett | F04B 49/065 |
| 9,897,082 | B2 * | 2/2018 | Worden | F04B 27/24 |
| 10,233,920 | B2 * | 3/2019 | Worden | F04B 49/02 |
| 11,085,430 | B2 * | 8/2021 | Matsumoto | F04B 25/00 |
| 2011/0046902 | A1 * | 2/2011 | Kyllingstad | F04B 51/00 702/51 |
| 2013/0167697 | A1 | 7/2013 | Reukers | |
| 2015/0251331 | A1 | 9/2015 | Vandergon et al. | |

FOREIGN PATENT DOCUMENTS

| | | | |
|---|---|---|---|
| WO | 2012034165 | A1 | 3/2012 |
| WO | 2014040125 | A1 | 3/2014 |
| WO | 2015127497 | A1 | 9/2015 |
| WO | 2018089299 | A1 | 5/2018 |

OTHER PUBLICATIONS

Written Opinion of the International Searching Authority dated Dec. 24, 2018 for corresponding International Application No. PCT/AU2018/051186, filed Nov. 2, 2018.

* cited by examiner

FAULT DETECTION AND PREDICTION

CROSS-REFERENCE TO RELATED APPLICATIONS

This Application is a Section 371 National Stage Application of International Application No. PCT/AU2018/051186, filed Nov. 2, 2018, which is incorporated by reference in its entirety and published as WO 2019/084620 A1 on May 9, 2019, in English.

FIELD OF THE INVENTION

The invention relates to faults in pumps and/or waterjet cutting systems. Preferred forms of the invention are concerned with identifying and locating leaks in pumps for waterjet cutting systems.

The invention will be described in the context of pumps for waterjet cutting systems although variants of the invention may be applied in other contexts such as high pressure pasteurisation (HPP) and compressing gases.

BACKGROUND TO THE INVENTION

The present inventor has previously developed a range of improvements in and for waterjet cutting as disclosed in international patent application nos. PCT/AU2008/000575, PCT/AU2009/000334, PCT/AU2011/001171, PCT/AU2013/001033 and PCT/AU2015/000105 to which the interested reader is directed for further information.

Waterjet cutting systems are complex systems based around a pump for supplying water at 345 MPa (about 50,000 psi) or more. Supplying such pressures is an extreme engineering challenge. At these pressures, water is compressable by about 12% or more.

Faults can and do occur in waterjet cutting systems from time to time. Such faults can be very costly. Typically, the system must be shut down, a technician called resulting in significant downtime before the technician even arrives on site. Once on site, identifying the fault can be difficult. By way of example, a pump might be consuming more power than expected but the cause of that additional power draw may not be immediately apparent.

The present inventor has recognised that water leaks are a particularly problematic class of faults because once such a leak has developed, the leaking water, driven by the extreme pressures, will tend to erode and damage any surrounding components. As such, often when a technician arrives on site, there is significant erosion resulting in much work to do which is both expensive and time consuming.

Accordingly, preferred variants of the technologies disclosed herein aim to provide for the easy and early identification of faults, or at least to provide alternatives for those concerned with pumps and/or waterjet cutting systems.

U.S. Pat. No. 6,092,370 discloses a pump, each pumping chamber of which has an inlet check valve, an outlet check valve and a plunger seal. Two temperatures are used to individually determine the operational status of the inlet check valve, the outlet check valve and the plunger seal.

It is not admitted that any of the information in this patent specification is common general knowledge, or that the person skilled in the art could be reasonably expected to ascertain or understand it, regard it as relevant or combine it in any way before the priority date.

SUMMARY

One aspect of the invention provides a pump including two or more pumping chambers;

one or more drive mechanisms for driving the two or more pumping chambers; and a logic arrangement;

a first pumping chamber of the two or more pumping chambers having a first inlet check valve, a first outlet check valve and a first temperature sensor to measure a first temperature;

a second pumping chamber of the one or more pumping chambers having a second inlet check valve, a second outlet check valve and a second temperature sensor to measure a second temperature;

the logic arrangement being configured to identify a leak by applying logic; and the logic including:

mutually comparing the first temperature and the second temperature; and mutually comparing a compression-stroke resistance of the first pumping chamber and a compression-stroke resistance of the second pump chamber.

The pump may include a second pumping chamber of the one or more pumping chambers;

the second pumping chamber having a second inlet check valve, a second outlet check vale and a second temperature sensor.

The first pumping chamber preferably has a first plunger, a first cylinder and a first plunger seal. The second pumping chamber preferably has a second plunger, a second cylinder and a second plunger seal. Most preferably, a cross-sectional area of the first plunger is substantially equal to a cross-sectional area of the second plunger. The pump may include plumbing for combining output from the first outlet check valve with output from the second outlet check valve. The pump may include a control arrangement for controlling the one or more drive mechanisms to cause the first pumping chamber to deliver a pressure substantially equal to a pressure delivered by the second pumping chamber.

Preferably the first temperature sensor is for sensing a temperature of or correlated with the first outlet check valve; and the second temperature sensor is for sensing a temperature of or correlated with the second outlet check valve.

Preferably the logic includes mutually comparing the output from the first temperature sensor and the output from the second temperature sensor. Preferably the logic includes mutually comparing a compression-stroke speed of the first pumping chamber and a compression-stroke speed of the second pump chamber. Most preferably the logic is to locate the leak, regardless of which the first plunger seal, the first inlet check valve, the first outlet check valve, the second plunger seal, the second inlet check valve and the second outlet check valve is leaking.

The one or more drive mechanisms may include an electric motor and a feedback sensor for providing a feedback signal indicative of at least one of a position and speed of the motor. The resistance-data may be at least based on the feedback signal.

The one or more data outlets may be configured to convey data via the internet. The pump is preferably configured to deliver at least 345 MPa (50,000 psi).

Another aspect of the invention provides a waterjet cutting apparatus including a cutting head and the pump for suppling the cutting head.

Another aspect of the invention provides a logic arrangement for a pump;

the pump including two or more pumping chambers; and one or more drive mechanisms for driving the two or more pumping chambers;

a first pumping chamber of the two or more pumping chambers having a first inlet check valve, a first outlet check valve and a first temperature sensor to measure a first temperature;

a second pumping chamber of the two or more pumping chambers having a second inlet check valve, a second outlet check valve and a second temperature sensor to measure a second temperature;

the logic arrangement including one or more data inlets for receiving resistance-data indicative of a resistance to the driving; and temperature-data at least based on output from the first temperature sensor and the second temperature sensor; and the logic arrangement being configured to identify a leak by applying logic;

the logic including mutually comparing the first temperature and the second temperature; and mutually comparing a compression-stroke resistance of the first pumping chamber and a compression-stroke resistance of the second pump chamber.

Another aspect of the invention provides a method of identifying a leak in a pump;

the pump including two or more pumping chambers; and one or more drive mechanisms for driving the two or more pumping chambers;

a logic arrangement;

a first pumping chamber of the two or more pumping chambers having a first inlet check valve, a first outlet check valve and a first temperature sensor to measure a first temperature;

a second pumping chamber of the one or more pumping chambers having a second inlet check valve, a second outlet check valve and a second temperature sensor to measure a second temperature;

the method including the logic arrangement applying logic;

the logic including mutually comparing the first temperature and the second temperature; and mutually comparing a compression-stroke resistance of the first pumping chamber and a compression-stroke resistance of the second pump chamber.

The method may include receiving, via the internet, resistance data and the temperature-data.

The method may include signaling, the leak, in response to the identification and via the internet.

Another aspect of the invention provides a waterjet cutting apparatus including one or more sensors.

Another aspect of the invention provides a logic arrangement, for monitoring a condition of a waterjet cutting apparatus including one or more sensors, including a data inlet for receiving data at least based on the output from the one or more sensors.

Another aspect of the invention provides a pump, for pumping fluid, having a temperature sensing arrangement for providing temperature data indicative of a temperature difference associated with operation of the pump;

a sensing arrangement for providing pressure data indicative of a pressure difference associated with the operation of the pump; and a logic arrangement configured to identify a fault based on the temperature data and the pressure data.

The pump may be a positive displacement pump including at least one pumping chamber. The pressure difference may be across the at least one pumping chamber. The at least one pumping chamber may have an outlet check valve. The temperature difference may be from a temperature of or correlated with a temperature of the fluid entering the pumping chamber to a temperature of or correlated with a temperature of the outlet check valve.

The logic arrangement may be configured to so identify based on a comparison at least substantially equivalent to a comparison of one of the temperature difference and the pressure difference to a parameter proportional to the other of the temperature difference and the pressure difference.

Another aspect of the invention provides a method, of identifying a fault in a pump, including obtaining temperature data indicative of a temperature difference associated with operation of the pump;

obtaining pressure data indicative of a pressure difference associated with the operation of the pump; and applying logic to the temperature data and the pressure data.

DETAILED DESCRIPTION

Figure 1:
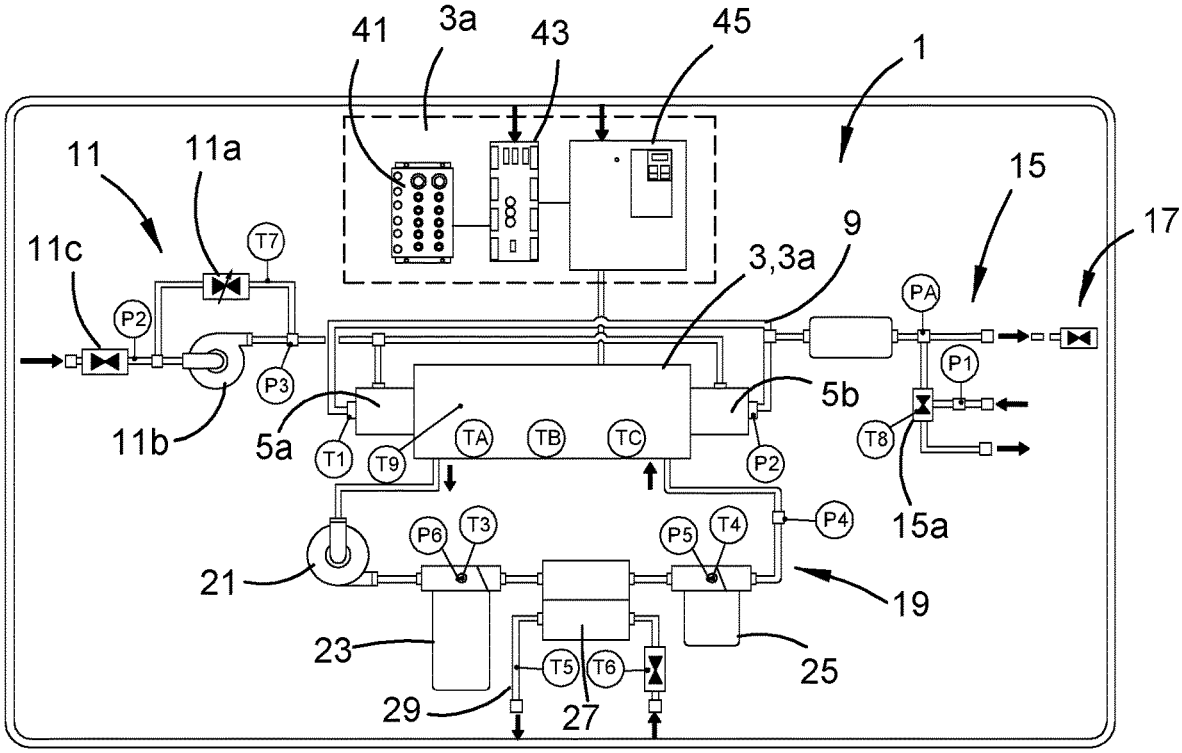
FIG. 1 schematically illustrates a waterjet cutting system.

FIG. 1 illustrates a waterjet cutting system 1 built around a pump 3. The pump 3 has a pump chamber 5*a*, 5*b* at each end. The chamber 5*a* is substantially identical to the chamber 5*b*. Each of the pump chambers 5*a*, 5*b* is connected to draw water from a common low pressure feed 7 and to pump water to a common high pressure feed 9.

The low pressure feed 7 is connected to draw water from a water supplying arrangement 11. The arrangement 11 incorporates a valve 11*a* and a rotodynamic booster pump 11*b* arranged in parallel to each other and to connect an inlet valve 11*c* to the lower pressure feed 7. The valve 11*c* selectively connects the system 1 to a mains water supply. Typically, the valve 11*a* is open and the pump 11*b* is inactive, but the states of those components can be reversed to supply additional water to the pump 3 if need be.

An attenuator 13 connects the high pressure feed 9 to further plumbing 15 by which the pump 3 is connected to cutting head 17. The further plumbing 15 incorporates a dump valve 15*a* including an air inlet for dumping water when required.

The pump 3 includes a single linear actuator 3*a* between and mutually connecting the pumping chambers 5*a*, 5*b*. The actuator 3*a* preferably takes the form of a screw-member, a nut-arrangement co-operable with the screw-member, and a stator surrounding, to rotationally drive, the nut-arrangement.

By way of example, the nut-arrangement may carry magnets co-operable with the stator. The stator is preferably part of a servo motor. The nut-arrangement and screw-member are preferably a ball screw, although a roller screw would also be suitable. Whilst preferred forms of the invention incorporate a nut-and-screw arrangement and a coaxial stator, other variants are possible. By way of example, various of the advantageous technologies described in here can be applied to double acting hydraulic intensifier pumps.

The actuator 3*a* is serviced by a lubricant loop 19 about which oil is pumped by pump 21 to lubricate the interior of the actuator 3*a*. First and second filters 23, 25 are mounted along the loop 19 and are separated by a heat exchanger 27 through which the oil is cooled by cooling water 29.

Figure 2:
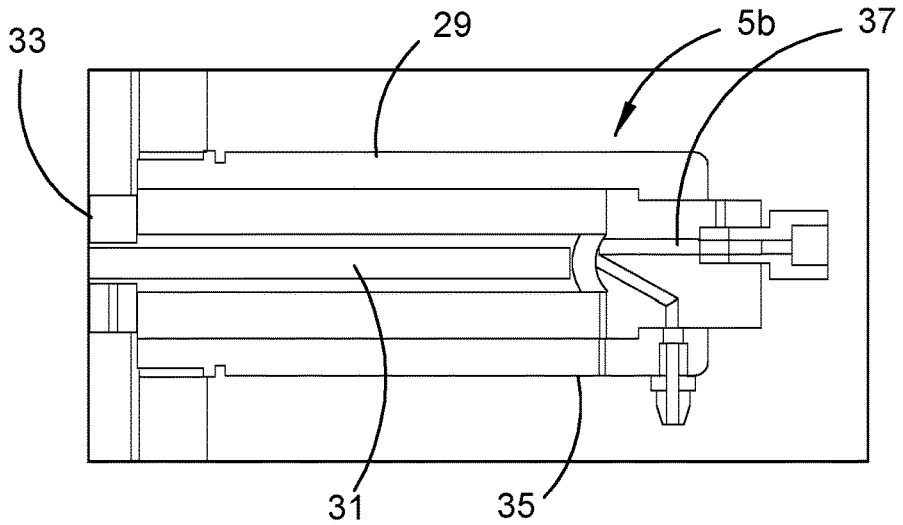
FIG. 2 is a transverse cross-section view of a pumping chamber.

FIG. 2 is a cross-section view of the pumping chamber 5*b*. The chamber 5*b* incorporates a cylinder 29 and plunger 31. The plunger 31 is connected to an end of the screw-member and mounted to slide through a high-pressure seal 33. The seal 33 separates the pumping chamber 5*b* from the interior of the actuator 3*a* and as such separates the water from the oil. A check valve 35 defines an inlet into the pumping chamber 35*b* whilst a check valve 37 defines an outlet from the chamber 5*b*. As the plunger 31 is reciprocally driven by the actuator 3*a*, the internal volume of the chamber 5*b* varies and the valves 35, 37 open and close to positively displace fluid through the chamber 5*b*. Some of the technologies described herein may be applied to positive displacement pumps other than plunger and cylinder pumps e.g. to diaphragm-type pumps.

Components 33, 35, 37 are highly stressed components at risk of leakage that leads to erosion. The inventor has recognised that monitoring a temperature of each of the pumping chambers 5*a*, 5*b* and applying logic to those temperatures and to resistance-data such faults can be efficiently identified, potentially before problematic erosion is caused.

Figure 3:
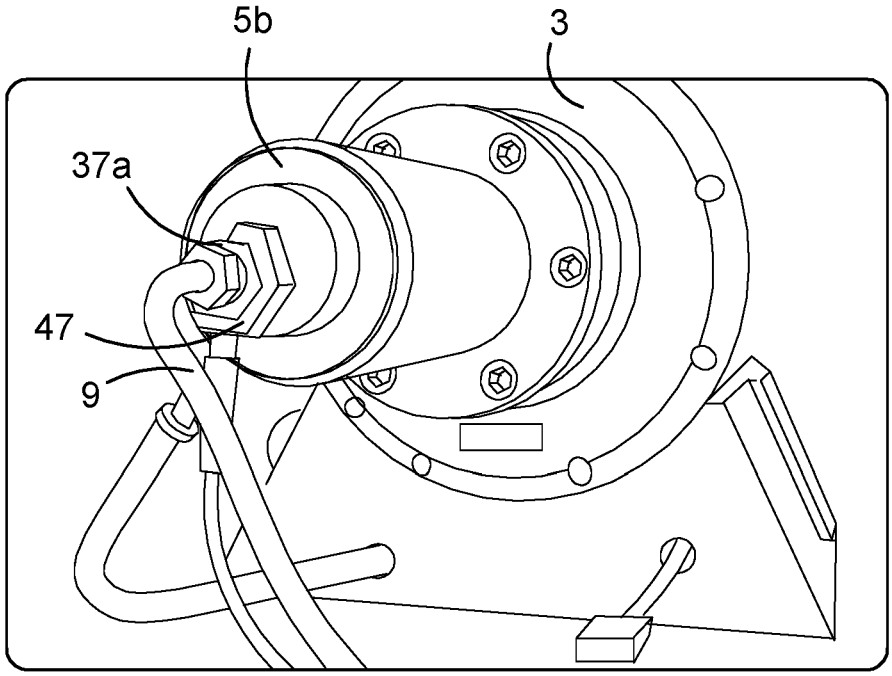
FIG. 3 is a perspective view of an end of a pump.

FIG. 3 is a perspective view of an end of a pump 3 illustrating a preferred temperature sensor 47. The chamber 5*b* has an outlet fitting 37*a* via which the chamber is connected to the high pressure feed 9. The sensor 47 embraces an exterior of the fitting 37*a*. In this example, it embraces a hexagonal portion of the exterior. Through this mounting arrangement, the sensor 47 produces an output that is highly correlated with a temperature of the check valve 37.

Preferred variants of the pump 3 incorporate a power and data arrangement 39 incorporating a sensor module 41, a control module 43 and a drive module 45. The drive module 45 electrically drives the actuator 3*a*. The modules 41, 43, 45 are operatively connected to each other. Preferably the modules are commonly housed although distributed arrangements are also possible.

Preferably the logic is implemented by the control module 43 although other logic arrangements are possible. The logic arrangement may be a distributed logic arrangement, potentially including components of the arrangement connected via the internet. One example of the pump includes a data outlet for conveying towards the logic arrangement data at least based on the output from the first temperature sensor and the output from the second temperature sensor. The conveyed data may directly correspond to those two outputs. Alternatively, the conveyed data may directly correspond to a difference between those two outputs. The terminology 'data at least based on output from the first temperature sensor and output from the second temperature sensor' and similar terminology as used herein embraces both possibilities.

The data outlet could be a connection arrangement for connecting to the internet. In other variants, substantially all of the logic arrangement is mounted in proximity to the actuator 3*a*, in which case the data outlet may be as simple as a cable. The logic arrangement preferably also takes account of feedback from the drive 45.

Each of the outlet check valves 37 opens to the high pressure feed 9 whereby the high pressure feed 9 constitutes plumbing for combining the outputs of the two check valves and the pumping chambers 5*a*, 5*b* face a substantially identical system curve. Other plumbing arrangements that lead to the two chambers facing substantially identical system curves are possible.

Preferably the drive is configured so that each of the pumping chambers 5*a*, 5*b* delivers substantially the same pressure whereby any difference in the speed of the compression-strokes of the chambers is likely to be associated with leakage. Most preferably this is achieved by the control module 43 receiving and responding to output from a pressure sensor PA configured to sense the pressure of the high pressure feed 9. As such, the modules 43, 45 together constitute a control arrangement for controlling the pump so that the pump chambers deliver the same pressure. In this example, the pressure sensor PA is mounted downstream of the accumulator 13.

When the pump chambers are controlled to deliver substantially the same pressure, the speed of the plungers becomes an indication of their resistance to the drive. If a particular chamber is leaking, typically that will reduce the resistance to the driving of the plungers whereby the plunger must be accelerated to maintain the desired pressure. The indication of plunger speed is preferably provided by the servo motor, although a sensor to directly measure the speed and/or position of the plungers (or a component, e.g. ball screw, fixed relative to the plungers) is another possibility.

Compression-speed is but one example of resistance-data. Other forms of resistance-data may be utilised e.g. in the case of a pump controlled to operate at a fixed speed, the electrical current drawn by the pump's motor(s) might be monitored to provide an indication of the resistance to the driving force provided by that motor.

Figure 4:
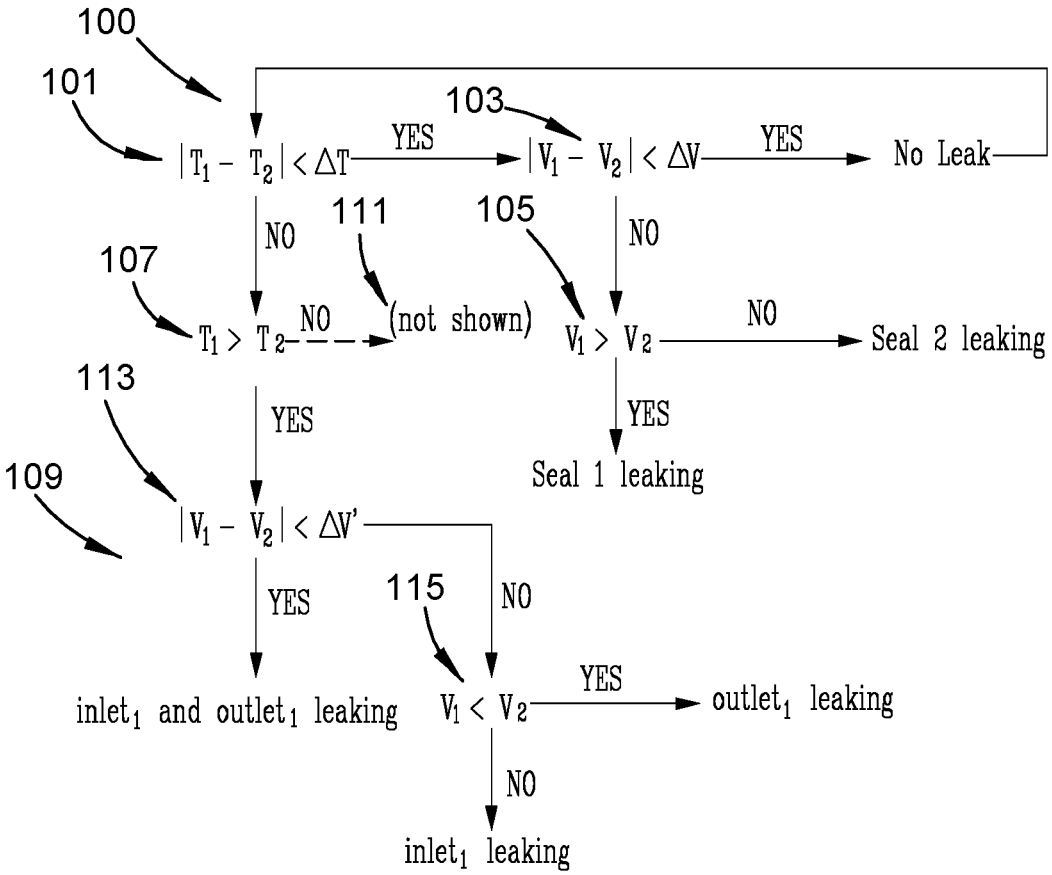
FIG. 4 is a logic diagram.

FIG. 4 illustrates a preferred form of the logic 100. In FIG. 4, the temperature at the first and second ends of the pump are designated $T_1$, $T_2$ respectively and the compression-stroke for the first and second ends of the pump are designated $V_1$, $V_2$ respectively.

The logic commences with a comparison 101 to assess whether the two temperatures are approximately equal. By way of example, the comparison may entail assessing whether the modulus of $T_1$-$T_2$ is less than a threshold $\Delta T$. If the temperatures are approximately equal, the velocities are likewise compared at step 103. If the velocities are approximately equal, this combination of observations is taken to mean that there is no leak and the logic arrangement returns to step 101. Thus, the steps 101, 103 form a loop about which the logic arrangement iterates until it suggests an above-threshold difference between the temperatures or compression-stroke velocities is detected.

If the temperatures remain substantially identical and a difference in velocities is detected, the logic arrangement moves from step 103 to step 105 at which the faster end is identified. The high pressure seal (e.g. seal 33) associated with that end is likely to be leaking.

At this juncture in the logic 100 there are a variety of possible responses that may be implemented. An alarm signal may be sent and/or an interlock mechanism activated to deactivate the pump 3. Optionally the pump may be allowed to continue to operate until a second threshold velocity difference is detected whereby the pump can, for example, continue to operate with some minor leakage but automatically stop once the leakage has reached a level deemed likely to cause problematic erosion.

Whilst the logic arrangement is iterating about the loop 101, 103, if a difference in the temperature is detected the logic arrangement moves on to step 107 at which the hotter of the two ends of the pump is identified. If the first end is hotter, the logic moves on to branch 109. If the second end is the hotter end, the logic moves on to branch 111. The branch 111 is akin to the branch 109 but not detailed in FIG. 4.

Along branch 109, the compression-stroke velocities are compared at step 113. The threshold velocity difference ΔV' may or may not be the same as the threshold of ΔV in step 103. If one end of the pump is hot but both ends are moving in substantially the same velocity, that is regarded as an indication that both the inlet and outlet valves (e.g. valves 35, 37) of the hotter end are leaking. If there is a velocity difference, the logic 100 moves on to step 115 at which the faster end is identified.

If the hotter end is the faster end, that is an indication that the inlet valve on the hotter end is leaking. The additional velocity is resultant from the drive 45 accelerating the plunger to maintain the delivery pressure whilst water is escaping past the inlet check valve. The reversal of fluid through the leaking (but still restrictive) check valve produces heat.

If the hotter end of the pump is the slower end, that is an indication that the outlet valve on that end is leaking. The difference in velocity arises from the control arrangement 45 accelerating the plunger on the compression-stroke of the colder end to compensate for leakage through the outlet valve of the hot end. Heat is generated by the water being forced through the leaking, but restrictive, outlet valve.

As per the discussion in respect of leaking seals being identified, once one or more valves have been identified as leaking, alarms may be raised, a monitoring mode may be entered and/or an interlock activated.

Figure 5:
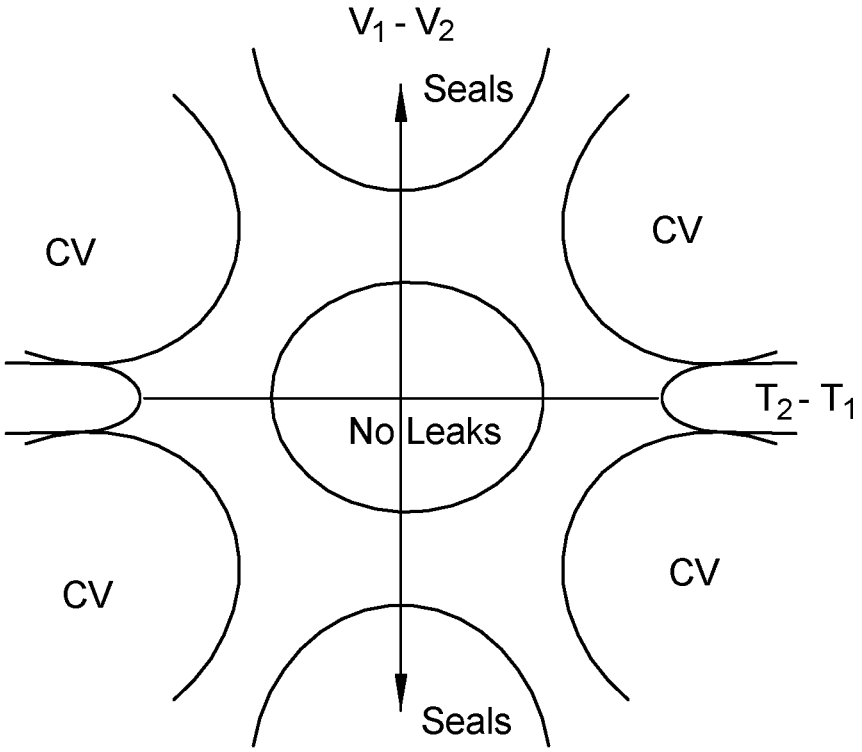
FIG. 5 is another representation of the logic.

FIG. 5 is another representation of the logic 100. FIG. 5 is a 2D plot in which the temperature difference and the velocity difference are plotted on the horizontal and vertical axes respectively. The central region represents fault-free operation whereas a departure from the central region is suggestive of a fault:

- a departure along the vertical axes is suggestive of one seal or the other leaking;
- a departure along the horizontal axes is suggestive of both check valves at one end of the pump leaking; and
- a departure along a diagonal is suggestive of one of the check valves leaking.

Preferred forms of the logic 100 preferably include allowances for the transient behavior of the pump. One option may entail delaying for a predetermined period of time, e.g. 1 minute, after the pump has been activated before moving to step 101. In addition, or as an alternative to a predetermined delay period, the control arrangement may be configured to move to step 101 only after certain parameters of the pump have met one or more predefined stability criterion. In addition or as an alternative to these possibilities, the thresholds applied as part of the logic (at steps 101, 103 and 113 in this example) may vary as a function of time and/or one or more other parameters.

Preferred forms of the invention monitor the sensor data to not only detect but predict the occurrence of faults. By way of example, a rate at which a relative difference in parameters is growing may be monitored to predict when that difference will cross a threshold deemed to be problematic.

Preferred variants of the waterjet cutting system 1 incorporate one or more of the following sensors:

| ITEM NO. | DESCRIPTION |
|---|---|
| T1 | TEMPERATURE: CHECK VALVE 1 |
| T2 | TEMPERATURE: CHECK VALVE 2 |
| T3 | TEMPERATURE: HOT OIL OUT |
| T4 | TEMPERATURE: OIL COLD IN |
| T5 | TEMPERATURE: COOLING WATER IN |
| T7 | TEMPERATURE: CUTTING WATER |
| T8 | TEMPERATURE: DUMP VALVE |
| T9 | OIL LEVEL SENSOR |
| P1 | PRESSURE: AIR |
| P2 | PRESSURE: CUTTING WATER, BEFORE BOOSTER PUMP |
| P3 | PRESSURE: CUTTING WATER, AFTER BOOSTER PUMP |
| P4 | PRESSURE: AFTER SMALL FILTER |
| P5 | PRESSURE: BEFORE SMALL FILTER |
| P6 | PRESSURE: OIL BEFORE LARGE FILTER |
| PA | PRESSURE TRANSDUCER |
| TA | TEMPERATURE: ACTUATOR HOUSING |

Instrumenting the system in this way can enable one or more of the following faults to be identified, located and/or predicted:

- Blocked Oil Filters or Damaged Oil Pump
  - Premature ball screw and bearing failure
  - Shortened seal life
- Insufficient cutting water supply (either low pressure or insufficient volume)
  - Cavitation damage to seals, cylinders and check valves
- Low air pressure
  - Leaking dump valve and or Cutting Head causing damage to the needle and seat
- Low oil level
  - Damaged ball screw or bearings
- Leaking needle and seat in Dump Valve
  - Erosion damage to the dump valve
- High motor torque
  - Damaged ball screw or bearings
  - Damaged plunger This instrumentation enables another approach to fault identification that may be utilised in addition to or as an alternative to the previously described approaches. The present inventors have recognised that in normal, fault-free, operation the temperature differences within various portions of the pumping system are related to pressure differences within the pumping system and as such deviations from these normal relationships can be used to identify faults. A preferred implementation of the concept entails determining a pressure rise ΔP across the chamber 5*b* by subtracting the pressure of the fluid entering the chamber 5*b* (as determined by sensor P3) from the outlet pressure (as determined by the sensor PA). A temperature difference ΔT between the outlet check valve 37 and the inlet water temperature is determined by comparing the outputs of the sensors $T_2$, $T_7$.

In normal operation these factors are relatable in accordance with the following relationship:

$$\Delta T = K\Delta P$$

Accordingly KΔP is a parameter proportional to the pressure difference ΔP that may be conveniently compared to the temperature difference to identify a fault as follows:

$$|\Delta T - K\Delta P| < C$$

wherein C fault is a criterion for the identification of a fault. The following are equivalent expressions of the same comparison:

$|\Delta T/K-\Delta P|<C'$ $|\Delta T/\Delta P-K|<C''$

The K value may be selected so that ΔT corresponds to the adiabatic temperature rise. Alternatively it may be a calibrated value or another value otherwise preset to suit a particular application.

The sensors P3, PA are one example of a sensing arrangement for providing pressure data indicative of a pressure difference. Other examples are possible. In another example wherein the inlet pressure is constant the pressure sensor PA is itself a sensing arrangement providing pressure data indicative of the pressure difference across the pumping chamber 5*b*. In yet another example, the actuator 3A may be the sensing arrangement. An output from the actuator indicative of the motor's drive torque is indicative of the outlet pressure in that it may be directly related to the outlet pressure via the pitch of the ball screw and the diameter of the plunger 31.

FIG. 200 is a logic diagram illustrating logic 200 by which the pressure data is combined with logic 100' akin to logic 100 for improved fault finding. The logic 200 is separately applied to each of the two cylinders of the pump.

At step 201 output from the pressure sensors P3, PA is processed to determine the pressure rise ΔP across the cylinder. At step 203 that value is multiplied by predetermined constant K to determine an expected temperature rise ΔT. At step 205 that ΔT and the inlet water temperature (provided by temperature sensor $T_7$) are summed to produce an anticipated outlet temperature $T_{ref,A}$.

At step 207 the anticipated outlet temperature $T_{ref,A}$ and the outlet temperature from the other end of the pump $T_{ref,B}$ are taken into account to determine a reference temperature $T_{Ref}$ for the cylinder under consideration. The processing step 207 could take a variety of forms. In one example, a lowest of the two inputs may be selected. In another example the two inputs may be averaged. From this juncture forward the logic may substantially follow the logic 100 including a comparison 101' of the cylinder temperature to the reference temperature $T_{Ref}$ and a comparison of the velocities at 103'.

Figure 7:
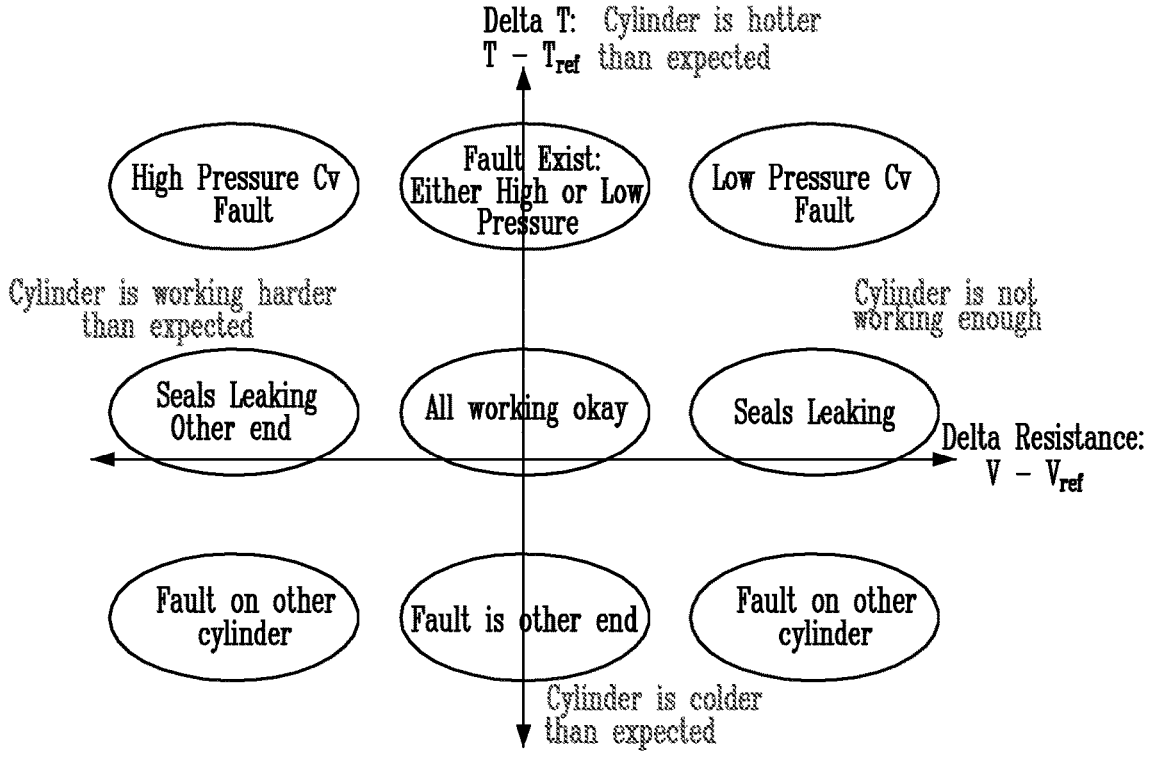
FIG. 7 is another representation of the logic of FIG. 6.
Figure 8:
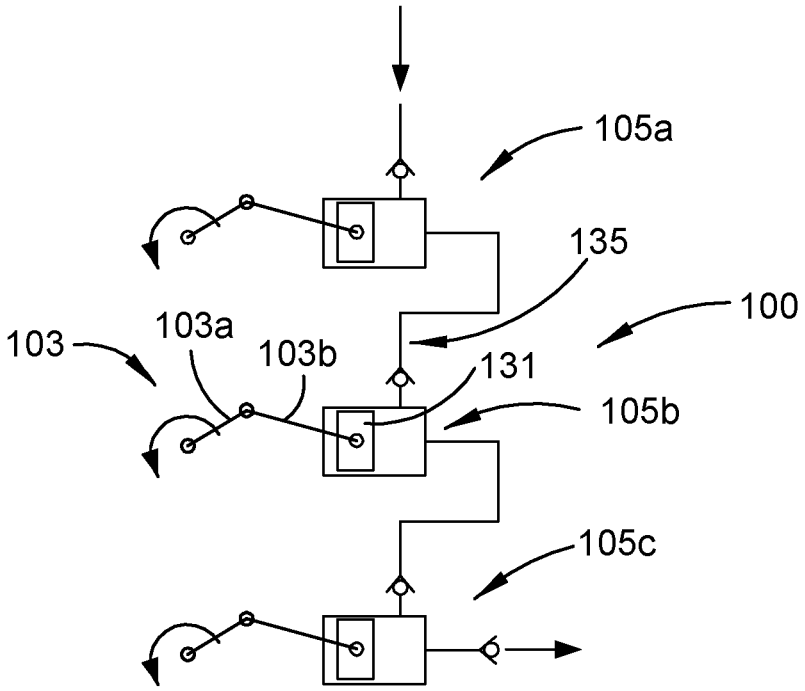
FIG. 8 schematically illustrates another pump.

FIG. 7 plots the output of the logic 200 when applied to one end of the pump. As illustrated, the logic enables a leaking one of the two check valves and the seal at the one end of the pump to be specifically identified.

Figure 6:
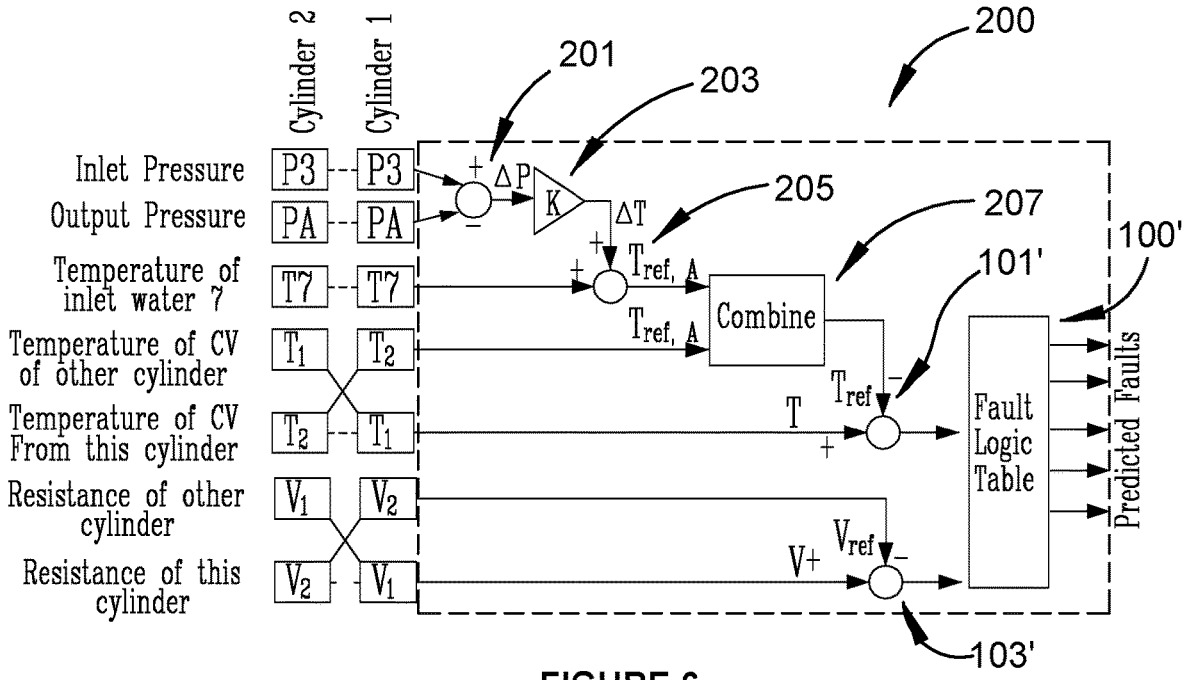
FIG. 6 is another logic diagram.

The pump 3 incorporates a single drive mechanism in the form of linear actuator 3*a* driving two pumping chambers 5*a*, 5*b*. The pumping chambers 5*a*, 5*b* are plumbed in parallel to each other and are utilised to pump water for waterjet cutting. FIG. 6 illustrates a contrasting example. The pump 100 incorporates a trio of pumping chambers 105*a*, 105*b*, 105*c* plumbed in series for pumping a gas. Each of the chambers has a respective drive 103 incorporating a rotationally driven crank 103*a* and a conrod 103*b* connecting the crank 103*a* to a piston 131 of the pump chamber 105*b*. Piston-cylinder arrangements are alternatives to plunger-cylinder arrangements.

The chamber 105*b* has its inlet check valve 135 mounted along a line communicating the interior of the chamber 105*a* to the interior of the chamber 105*b*. As such, the chambers 105*a*, 105*b* share the check valve 135; the chamber 105*a* has the check valve 135 as its outlet check valve.

The drive 103 further includes a combustion engine arranged to rotationally drive the crank 103*a*. The engine incorporates a governor by which the engine is throttled to deliver a constant shaft speed. In this example, a position of the throttle is resistance-data indicative of the resistance to the drive of the pumping chamber. Applying strain gauges, or another suitable sensing arrangement, to measure the drive torque is another option. Drive-power, e.g. shaft-power or electric motor input power, is also a possibility.

By instrumenting the pump 100 and applying logic to the resistance data and temperature data from the instruments, faults in the pump 100 may be identified in a manner akin to the manner described in respect of the pump 3.

The pump 3 incorporates chambers 5*a*, 5*b* which are substantially identical to each other and plumbed in parallel between the water supplying arrangement 11, the attenuator 13.

In another advantageous embodiment of the principles disclosed herein that is suited to compressing gases, the chamber 5*a* has an effective cross-sectional area about double the effective cross-sectional area of the chamber 5*b* and the chambers are plumbed in series via a suitable heat exchanger. Gas is compressed through the chamber 5*a*, cooled through the heat exchanger and then further compressed through the chamber 5*b*. In embodiments such as these, the speed of the plungers may well be asymmetric and the logic 100 adjusted accordingly. By way of example the test at step 103 might be replaced by $|V_1-1.5V_2|<\Delta V$. Likewise a different relationship between the two temperatures might be applicable.

Whilst various examples have been described, the invention is not limited to these examples. Rather, the invention is defined by the claims.

The invention claimed is:

1. A pump including:

two or more pumping chambers comprising compression stroke elements;

one or more drive mechanisms for driving the compression stroke elements; and a logic arrangement;

a first pumping chamber of the two or more pumping chambers having a first inlet check valve, a first outlet check valve and a first temperature sensor to measure a first temperature;

a second pumping chamber of the one or more pumping chambers having a second inlet check valve, a second outlet check valve and a second temperature sensor to measure a second temperature;

the logic arrangement being configured to:

identify a leak by applying logic, including:

mutually comparing the first temperature and the second temperature; and mutually comparing a compression-stroke resistance of the first pumping chamber and a compression-stroke resistance of the second pump chamber; and respond to the identification of the leak by at least one of:

signaling the leak; or deactivating the pump.

2. The pump of claim 1, wherein:

the first pumping chamber has a first plunger, a first cylinder and a first plunger seal; and the second pumping chamber has a second plunger, a second cylinder and a second plunger seal.

3. The pump of claim 2 wherein a cross-sectional area of the first plunger is substantially equal to a cross-sectional area of the second plunger.

4. The pump of claim 2 wherein the logic arrangement is further configured to locate the leak, regardless of which the first plunger seal, the first inlet check valve, the first outlet check valve, the second plunger seal, the second inlet check valve and the second outlet check valve is leaking.

5. The pump of claim 1 including plumbing for combining output from the first outlet check valve with output from the second outlet check valve.

6. The pump of claim 1 including a control arrangement for controlling the one or more drive mechanisms to cause the first pumping chamber to deliver a pressure substantially equal to a pressure delivered by the second pumping chamber.

7. The pump of claim 1 wherein:

the first temperature is a temperature of, or correlated with a temperature of, the first outlet check valve; and the second temperature is a temperature of, or correlated with a temperature of, the second outlet check valve.

8. The pump of claim 1 wherein:

the one or more drive mechanisms includes an electric motor and a feedback sensor for providing a feedback signal indicative of at least one of a position of the motor and a speed of the motor; and the mutually comparing the compression-stroke resistance of the first pumping chamber and the compression-stroke resistance of the second pump chamber at least based on the feedback signal.

9. The pump of claim 1 wherein the logic includes a comparison of one of a temperature difference across one of the pumping chambers and a pressure difference across the one of the pumping chambers to a parameter proportional to the other of the temperature difference and the pressure difference.

10. The pump of claim 1 being configured to deliver at least 345 MPa (50,000 psi).

11. A waterjet cutting apparatus including a cutting head; and the pump of claim 10 for suppling the cutting head.

12. The pump of claim 1 wherein the compression stroke elements comprise plungers, pistons or diaphragms.

13. A logic arrangement for a pump;

the pump including:

two or more pumping chambers comprising compression stroke elements; and one or more drive mechanisms for driving the compression stroke elements;

a first pumping chamber of the two or more pumping chambers having a first inlet check valve, a first outlet check valve and a first temperature sensor to measure a first temperature;

a second pumping chamber of the two or more pumping chambers having a second inlet check valve, a second outlet check valve and a second temperature sensor to measure a second temperature;

the logic arrangement including one or more data inlets for receiving:

resistance-data indicative of a resistance to the driving; and temperature-data at least based on output from the first temperature sensor and the second temperature sensor; and the logic arrangement being configured to:

identify a leak by applying logic, including:

mutually comparing the first temperature and the second temperature; and mutually comparing a compression-stroke resistance of the first pumping chamber and a compression-stroke resistance of the second pump chamber; and respond to the identification of the leak by at least one of:

signaling the leak; or deactivating the pump.

14. The logic arrangement of claim 13 wherein the logic includes a comparison of one of a temperature difference across one of the pumping chambers and a pressure difference across the one of the pumping chambers to a parameter proportional to the other of the temperature difference and the pressure difference.

15. The logic arrangement of claim 13, wherein:

the first pumping chamber has a first plunger, a first cylinder and a first plunger seal;

the second pumping chamber has a second plunger, a second cylinder and a second plunger seal; and the logic includes logic to locate the leak, regardless of which of the first plunger seal, the first inlet check valve, the first outlet check valve, the second plunger seal, the second inlet check valve and the second outlet check valve is leaking.

16. The logic arrangement of claim 13 wherein the compression stroke elements comprise plungers, pistons or diaphragms.

17. A method performed by a pump, the pump including:

two or more pumping chambers comprising compression stroke elements; and one or more drive mechanisms for driving the compression stroke elements;

a logic arrangement;

a first pumping chamber of the two or more pumping chambers having a first inlet check valve, a first outlet check valve and a first temperature sensor to measure a first temperature;

a second pumping chamber of the one or more pumping chambers having a second inlet check valve, a second outlet check valve and a second temperature sensor to measure a second temperature;

the method including the logic arrangement applying logic to:

identify a leak, including:

mutually comparing the first temperature and the second temperature; and mutually comparing a compression-stroke resistance of the first pumping chamber and a compression-stroke resistance of the second pump chamber; and respond to the identification of the leak by at least one of:

signaling the leak; or deactivating the pump.

18. The method of claim 17 including making a comparison of one of a temperature difference across one of the pumping chambers and a pressure difference across the one of the pumping chambers to a parameter proportional to the other of the temperature difference and the pressure difference.

19. The method of claim 18, wherein:

the first pumping chamber has a first plunger, a first cylinder and a first plunger seal;

the second pumping chamber has a second plunger, a second cylinder and a second plunger seal; and the logic arrangement further applies logic to locate the leak, regardless of which of the first plunger seal, the first inlet check valve, the first outlet check valve, the second plunger seal, the second inlet check valve and the second outlet check valve is leaking.

20. The method of claim 18 including receiving, via the Internet, the first temperature, the second temperature, the compression-stroke resistance of the first pumping chamber, and the compression-stroke resistance of the second pumping chamber.

21. The method of claim 17, wherein the logic arrangement responds to the identification of the leak by signaling the leak via the Internet.

22. The method of claim 17 wherein the compression stroke elements comprise plungers, pistons or diaphragms.

* * * * *